United States Patent [19]

Doublet

[11] Patent Number: 4,733,507

[45] Date of Patent: Mar. 29, 1988

[54] ISOLATION HUT

[75] Inventor: Luc Doublet, Seclin, France

[73] Assignee: S.A. Doublet Festitub, Pont-A-Marcq, France

[21] Appl. No.: 906,903

[22] Filed: Sep. 15, 1986

[30] Foreign Application Priority Data

Oct. 14, 1985 [FR] France ..... 85 15540

[51] Int. Cl.[4] ..... E04H 1/12

[52] U.S. Cl. ..... 52/63; 52/36; 52/79.1; 135/87

[58] Field of Search ..... 52/36, 63, 79.1, 79.5; 135/900, 901, 902, 87; 229/16 R, 41 B

[56] References Cited

U.S. PATENT DOCUMENTS

| | | | |
|---|---|---|---|
| 1,449,780 | 3/1923 | Reinhold | 52/63 |
| 1,514,038 | 11/1924 | Douglas | 52/63 |
| 1,704,689 | 3/1929 | Berg | 52/63 X |
| 2,837,777 | 6/1958 | White | 135/901 X |
| 3,383,028 | 5/1968 | Brander | 229/16 R |
| 3,616,986 | 11/1971 | Wolfe et al. | 229/16 R |
| 3,854,746 | 12/1974 | Flynn et al. | 135/901 X |
| 4,417,686 | 11/1983 | Wozniacki | 229/16 R X |

FOREIGN PATENT DOCUMENTS

| | | | |
|---|---|---|---|
| 18679 | 3/1914 | France | 52/63 |

*Primary Examiner*—J. Karl Bell

*Attorney, Agent, or Firm*—Sandler & Greenblum

[57] ABSTRACT

This isolation hut intended for temporary or provisional use, notably as a polling-booth during elections or like events, or as a transportable trying cubicle, a dressing-room during occasional events, or the like, consists of a frame structure made from a basic folding sheet of cardboard, pasteboard or light-weight multilayer material, or metal, comprising a plurality of lateral walls and a front access aperture. This structure is stiffened on the one hand by bending the basic sheet material and on the other hand by means of posts disposed at the corners of the structure, a cross bar constituting a lintel disposed at the top of the front aperture, and possibly a desk-forming element, all these elements being obtained by folding a flexible sheet of the same basic material as the basic folding sheet constituting the frame structure.

20 Claims, 8 Drawing Figures

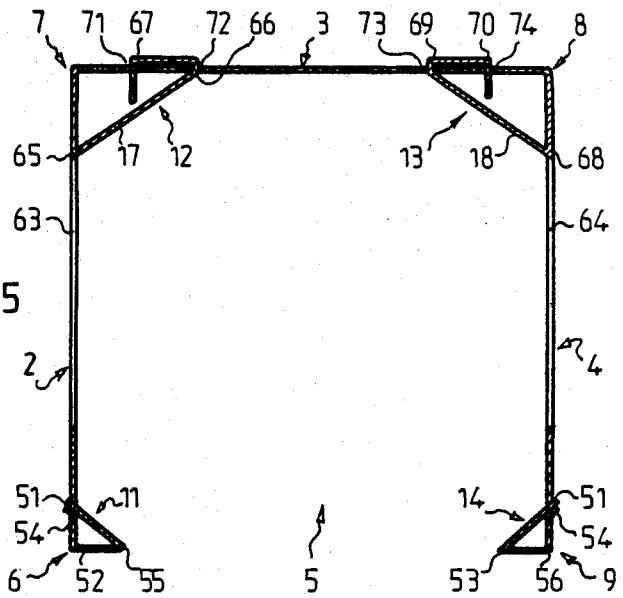
FIG. 5
FIG. 6
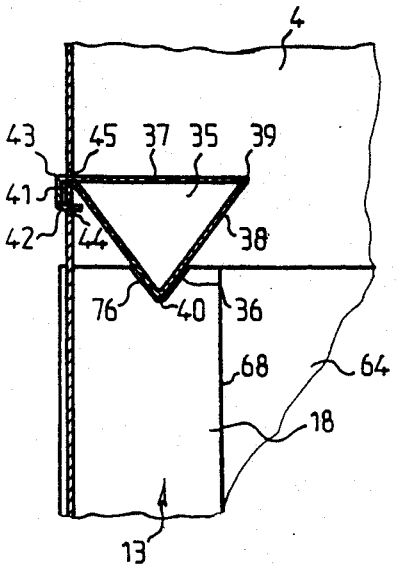
FIG. 8
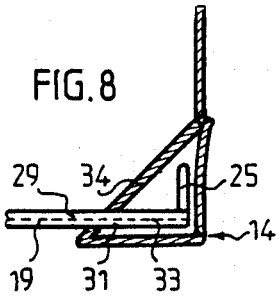
FIG. 7
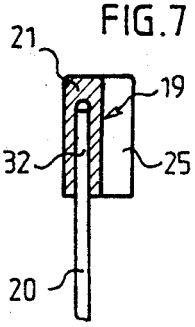

ISOLATION HUT

BACKGROUND OF THE INVENTION

1. Field of the Invention

The present invention relates to an isolation hut intended notably for temporary or provisional use, more particularly as a polling-booth for elections, a transportable trying-on cubicle, a dressing-box for occasional events, or the like.

In fact, in many cases, during occasional or temporary events, exhibitions, markets, elections, or other gatherings, it is convenient to dispose of closed huts permitting of isolating a person from the surroundings. However, since these isolation huts are intended for temperay use only they are preferably of the collapsible type to faciliate the storage of a number of huts when they are not in use.

2. The Prior Art

Various types of trying-on cubicles or dressing-boxes are already known. As a rule, they consist of a substantially parallelipipedic structure having three rigid lateral walls and a front opening protected by a curtain or door. These constructions are generally of the integral type comprising an assembly of several rigid walls of wood, synthetic material or metal, interconnected by various conventional means such as nails, screws or pins.

Another known isolation hut having a more specific configuration is the polling-booth used for elections or the like. It is substantially parallelipipedic and comprises four corner posts supporting rigid panels closing the upper portions of three sides of the booth so as to leave a bottom aperture through which one can see if the booth is occupied or not. Moreover, the front aperture thus left is closed by a curtain suspended from a bar secured to posts at the upper portion of the access aperture.

A specific feature of these various constructions is their strength because they are made of rigid elements. However, their scope and temporary used do not justify such solidity.

Moreover, these known isolation huts are generally stored in their disassembled condition to reduce their storage volume. This involves the presence of a great number of constructional elements which must nevertherless remain more or less paired to facilitate the reassembly thereof. In addition, it is a frequent occurence that, during the erection, dissassembling and storage operations, some elements are lost or damaged, so that the complete hut cannot be re-assembled and therefore becomes useless.

Finally, due to their particular structures, these known isolation huts are relatively expensive so that the buyers are confronted with heavy expenses when for instance polling-booths must be purchased in view of impending elections.

SUMMARY OF THE INVENTION

It is the primary object of the present invention to provide an isolation hut for temporary use, notably as a polling-booth in case of elections or other similar purposes, this isolation hut consisting of a flexible or folding material such as pasteboard, cardboard or light-weight multilayer material, so as to provide a light-weight, easily transportable structure which can be erected very easily and has a manufacturing cost considerably lower than hitherto known isolation huts or polling-booths.

It is another object of the present invention to provide a isolation hut of the type broadly set forth hereinabove which, though made from a flexible or folding material such as pasteboard, cardboard or light-weight multilayer material, has a good rigidity and a reliable stability while meeting the requirements consistent with its use.

Furthermore, the present invention has for its object an isolation hut made from a flexible or folding material such as pasteboard, cardboard or light-weight multilayer material, which comprises a minimum number of component elements and can be assembled without resorting to any conventional coupling or fastening means, the assembly being obtained by simple interlocking means.

Other objects and advantages of the present invention will appear as the following description proceeds with reference to a specific form of embodiment given by way of example, not of limitation.

According to the present invention, the isolation hut, notably in the form of polling-booth for election and like use, constructed from a flexible or folding basic material or from a light-weight multilayer material, has a plurality of lateral faces and a front access aperture, and is characterized by the fact that it comprises:

a self-supporting frame structure obtained by bending the basic material constituting the lateral walls and the front aperture of the hut, and a plurality of posts for imparting the necessary rigidity to the assembly, disposed along the vertical edges of the hut, and also obtained by bending a flexible or folding material similar to the material constituting the lateral walls of the hut.

BRIEF DESCRIPTION OF THE DRAWINGS

A clear understanding of the present invention will be had when reading the following description given with reference to the attached drawings, in which:

FIG. 5 is a section taken along the line V—V of FIG. 2, but showing the basic sheet in its folded condition, FIG. 6 is a section taken along the line VI—VI of FIG. 1, showing a detail of the isolation hut assembly, FIG. 7 is a section taken along the line VII—VII of FIG. 1, showing another detail of the isolation hut assembly, and FIG. 8 is a plane view from above, taken in the direction of the arrow VIII of FIG. 1, showing a detail of a folded and assembled corner of the isolation hut of the present invention.

DESCRIPTION OF THE PREFERRED EMBODIMENT

The present invention relates in general to an isolation hut intended more particularly for use in temporary events or occasional circumstances. The form of embodiment described hereinafter constitutes an isolation hut suitable for use as a polling-booth during elections.

However, the isolation hut of this invention could also be used in other circumstances, for examples as a trying-on cubicle, dressingbox or other particular applications, by simply adapting the technique of the present invention to the specific purpose contemplated.

Figure 1:
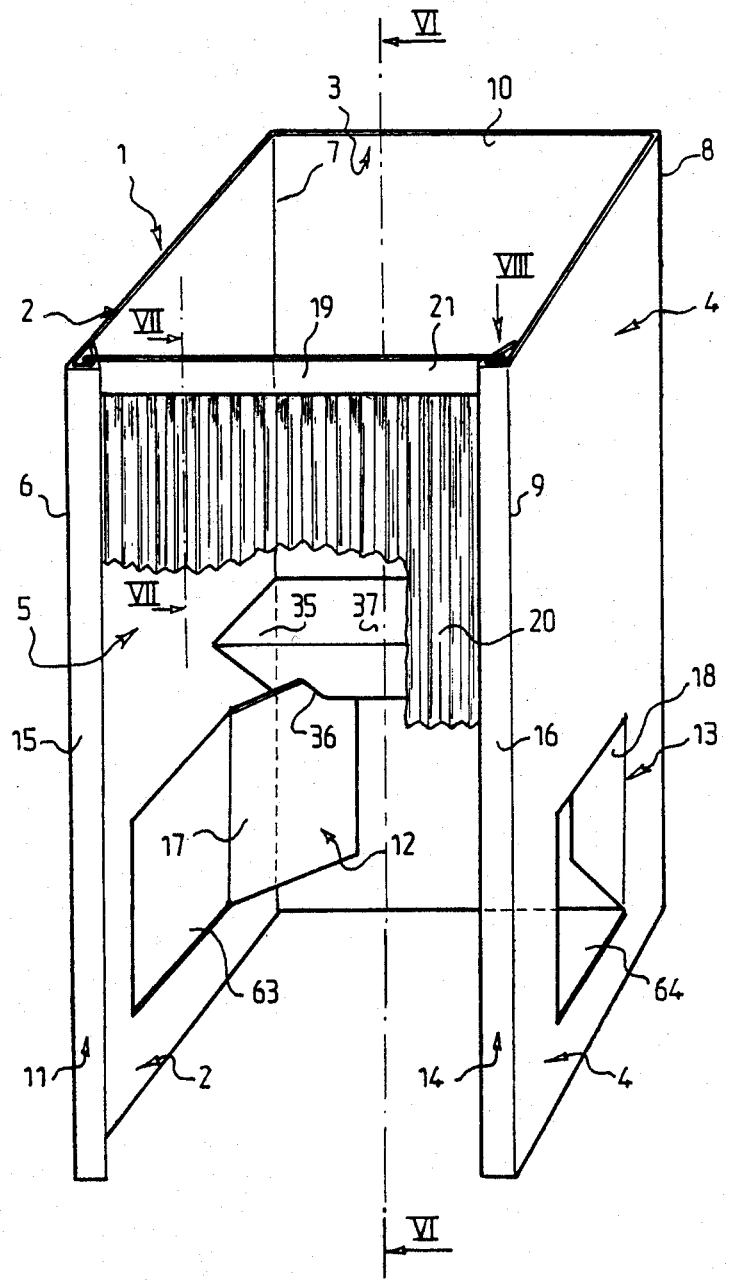
FIG. 1 is a perspective view of the isolation hut according to the present invention, in the case of a polling-booth.

FIG. 1 shows in perspective view an isolation hut 1 intended for use more particularly as a polling-booth. This polling-booth 1 has a conventional parallelipipedic configuration, but of course a polling-booth having a different geometrical configuration, for example a booth having a haxagonal cross-section, may also be contemplated without departing from the basic principles of the invention.

The isolation hut 1 or more particularly the polling-booth comprises a plurality of lateral walls 2, 3, and 4, notably three in number in the case of a parallelipipedic configuration, and a front access aperture 5.

The lateral walls 2, 3, 4, as well as the access aperture 5, are adjacent to each other and form a plurality of vertical or corner edges 6, 7, 8 and 9.

The isolation hut 1 is preferably and advantageously free of ceiling and floor. However, such ceiling and floor could be contemplated if their presence were definitely necessary.

According to the present invention, the isolation hut 1 is made essentially from a basic folding material 10 such as cardboard, pasteboard or light-weight multilayer material.

Figures 2, 3, 4:
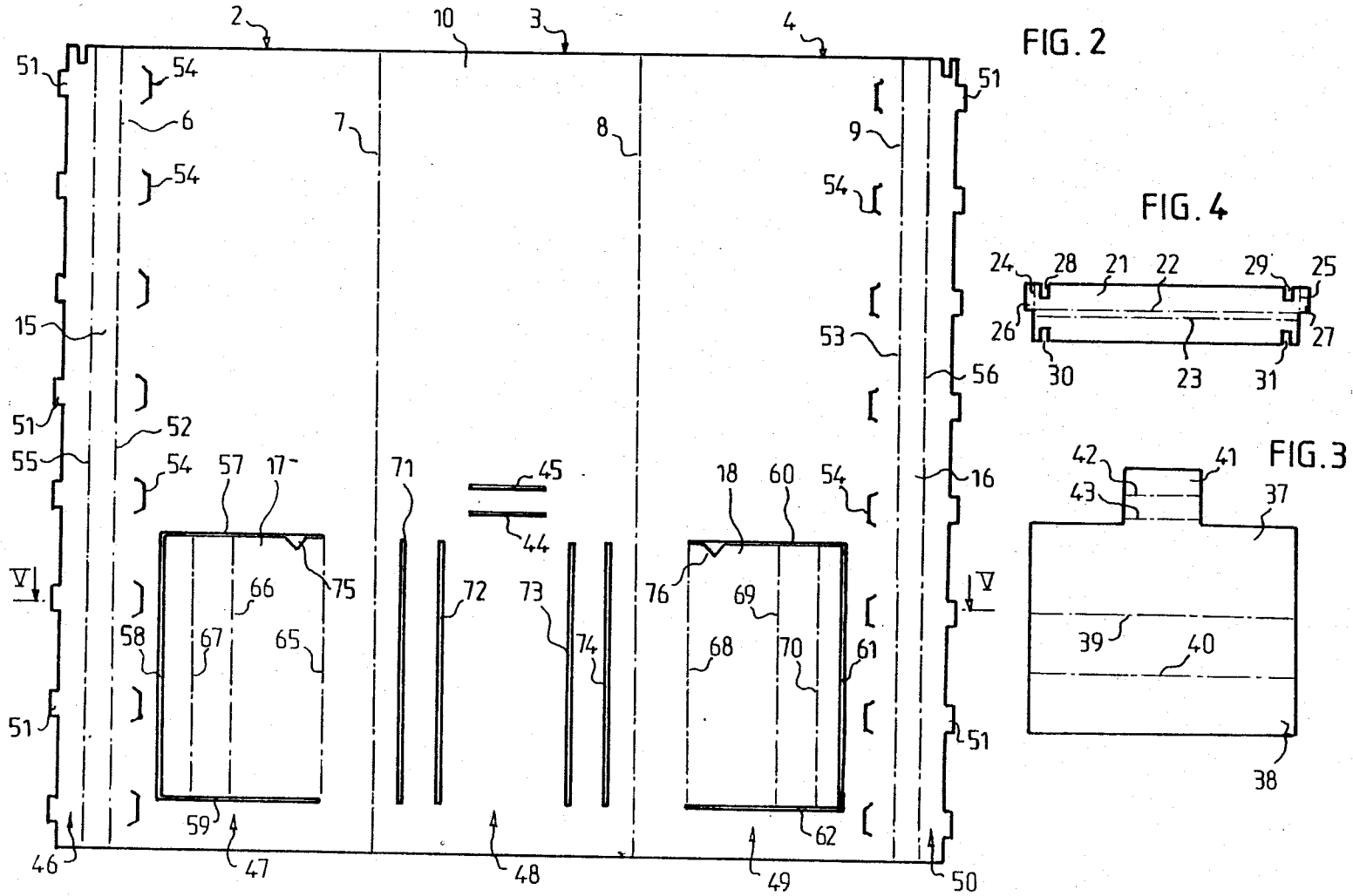
FIG. 2 is a plane view showing the basic folding sheet for making the isolation hut or polling-booth of FIG. 1.
FIG. 3 is a plane and unfolded view of a reinforcing element for the isolation hut of FIG. 1.
FIG. 4 is a view similar to FIG. 3 showing another reinforcing element of the isolation hut of FIG. 1.

Preferably, as shown in FIG. 2, this folding material 10 is in the form of a flat sheet in which a plurality of indentations and fold lines are formed.

According to a specific feature of the present invention, this isolation hut 1 comprises:

a self-supporting structure or framework obtained by folding the basic folding material 10 constituting the lateral walls 2, 3, 4 and the front access aperture 5 of the hut 1, and frame posts, which are two to four in number in the case of a parallelipiped, as shown by the reference numerals 11–14 in FIG. 1, for stiffening the aforesaid self-supporting structure or framework.

These frame posts 11–14 are advantageously disposed along the vertical edges 6–9 and formed by folding a sheet of basic flexible material similar to the material 10 constituting the self-supporting frame structure.

In a specific form of embodiment (not shown) the posts 11 may consist of tubular elements formed by folding a sheet of flexible material such as pasteboard, cardboard or other light-weight multilayer material, and have at least one corner corresponding to that formed by the lateral walls 2, 3, 4 and the access opening 5 along their edges 6–9.

In this first form of embodiment, the posts 11–14 are then aligned with, and secured to, the edges 6–9 of the hut framework 1, the assembly being obtained for example by fitting tongues into corresponding slots precut in the lateral walls.

However, according to a preferred form of embodiment, the front framework posts 11 and 14, respectively, extend along the front vertical edges 6 and 9, respectively, on either side of the front access aperture 5, by folding precut lateral sections 15 and 16 formed in the basic flexible material 10 constituting the hut framework 1. Thus, these front posts 11 and 14 are formed from the same basic material 10 and not added subsequently to the self-supporting framework, so that the rigidity of this framework will be further improved while simplifying the assembly operation.

Furthermore, in this preferred form of embodiment the intermediate framework posts 12 and 13, extending along the intermediate vertical edges 7 and 8, respectively, as defined by the junction of the adjacent lateral walls 2 and 3, are obtained by folding precut areas 17 and 18 formed in the basic flexible material in lateral walls 2 and/or 3 and/or 4.

This preferred form of embodiment will now be described with reference more particularly to FIGS. 2 and 5 of the drawings.

Moreover, to improve the rigidity and stability of the isolation hut 1 according to the present invention, the self-supporting framework of the hut is reinforced notably by a lintel-forming cross bar 19 disposed above the front access aperture 5, and acting at the same time as a means for bracing or rigidly interconnecting the two lateral walls 2 and 4 adjacent the aperture 5. In addition, this cross bar may advantageously be used for supporting a curtain 20 so as to conceal at least partially the access aperture 5.

As shown notably in FIGS. 4, 7 and 8 of the drawings, this cross bar 19 is also formed by folding another sheet 21 advantageously of the same material as the first basic sheet 10. This other sheet 21 has fold lines 22, 23, 24 and 25 formed therein as well as external tongues 26, 27 and notches 28–31 so that it can be folded in such a way as to form a channel 32 in the cross bar for receiving the top edge of curtain 20, as shown notably in FIG. 7, the end portions 33 of cross bar 19 being adapted to be engaged through matching apertures formed in the upper ends of the front lateral posts 11 and 14, as shwon notably in FIGS. 1 and 8.

More particularly, the notches 29 and 31 permit of fitting the cross bar 19 on the wall 34 of front post 11 or 14, while the tongues 25 and 26 permit of locking the cross bar 19 against axial translation inside the corresponding tubular post.

On the other hand, when the isolation hut of this invention is used as a polling-booth 1, the assembly will comprise preferably a writing-desk 35 disposed substantially horizontally at mid-height of one of the lateral walls 2–4, preferably on lateral wall 3 substantially opposite the access aperture 5.

This desk 35 is convenient for the elector when voting but it has the complementary advantage of reinforcing the framework of the hut 1. In fact, this writing-desk 35 is so designed that it can act as a bracing member between the other two adjacent lateral walls 2 and 4. Furthermore, it may be disposed horizontally by fitting (as shown at 36) in the intermediate posts 12, 13, as shown notably in FIG. 1.

In a preferred form of embodiment of the invention, as shown in FIGS. 3 and 6 of the drawings, the desk 35 is obtained by folding a third flat sheet 37 advantageously in the same fashion as the first sheet 10. This third flat sheet 37 constituting the desk top obtained by folding the sheet along two fold lines 39 and 40, thus providing a front inclined face 38. A tongue 41 projecting from the edge of sheet 37 which is opposite the fold line 39 has two fold lines 42 and 43 formed therein so that the desk 35 can be anchored to the lateral wall, notably 3, by engaging corresponding slots 44 and 45, respectively, formed in said lateral wall.

It will be seen that the folding portion constituting the desk 35 may advantageously have a triangular cross section, thus facilitating appreciably the interfitting at 36 of the lower edge of the desk structure with the intermediate posts 12 and 13 adjacent said structure.

However, other shapes may be contemplated without departing from the basic principles of the invention.

FIG. 2 shows a preferred form of embodiment of the basic folding sheet 10 and FIGS. 5 and 6 show in detail the folding steps permitting of assembling the self-supporting framework of the hut 1 stiffened by the corner posts 6–9 according to the present invention.

In the case of a substantially parallelipipedic isolation hut 1, the basic sheet 10 has a substantially rectangular or quadrangular horizontal cross-section divided into five different main portions 46–52 (FIG. 2), for constituting a first front frame post 11, a first lateral wall 2, the rear wall 3 and a second lateral wall 4, adjacent the second front frame post 14, respectively.

The sheet of basic folding material 10 comprises in its endmost or vertical edges 46 and 50 a plurality of indentations 51 providing for instance a plurality of small tongues, disposed at spaced intervals adjacent the front edges 6 and 9 consisting in this case sunstantially and respectively of the aforesaid fold lines 52 and 53.

Moreover, a plurality of precut slots 54 are also formed adjacent the front edges 6 and 9 and adapted to be engaged by said tongues 51. Thus, when the sheet 10 is folded along the lines 52, 55 on the one hand and 53, 56 on the other hand, the mutual engagement of said slots 54 and tongues 51 permits of constituting the framework posts 11 and 14, as shown notably in FIG. 5.

Thus, during the assembly step, the tongues 51 are inserted into the slots 54 and the sheet 10 is held in its folded condition to constitute the front posts 11 and 14 having a tubular configuration and a substantially triangular cross section. However, posts having a different cross-sectional shape may also be contemplated.

For obtaining the intermediate framework posts 12 and 13 the basic sheet 10 of flexible material comprises at least in its areas 47 and 49 a pair of C-shaped cut portions 17 and 18 in the lower portions of lateral walls 2 and 4 for constituting the intermediate bracing or reinforcing elements 12 and 13 by folding said portions 17 and 18 and fixing the free vertical edge thereof to the adjacent lateral wall.

As clearly shown in FIG. 2, each cut portion 17, 18 consists of a series of three contiguous slots 57–59 and 60–62 providing on the one hand the material necessary for folding and constituting said bracing elements 12 and 13, and on the other hand a bottom aperture 63, 64 in said lateral walls 2, 4.

Moreover, the cut portions 17 and 18 comprise fold lines 65–67 and 68–70, respectively, for obtaining lower framework posts in the form of tubular elements of substantially triangular cross section, as shown in FIG. 5.

The area 48 of sheet 10 which constitutes the rear wall 3 of the hut has precut slots 71–74 formed therein, which correspond to, and cooperate with, fold lines 66, 67, 69 and 70, and are adapted to receive the cut portions 17 and 18 for constituting the rear posts in conjunction with the self-supporting framework.

Of course, other types of cut portions 17 or 18, and different positions thereof, may be contemplated without departing from the basic principles of the invention. Thus, for example, it is also possible to provide on the rear lateral wall 3 a double cut portion adapted to be folded on each adjacent lateral wall 2 and 4, and on these adjacent lateral faces 2 and 4 retaining slots so as to form symmetric posts without forming the above-mentioned apertures 63 and 64 in the left and right lateral walls 2 and 4, the assembly comprising only one aperture in the rear lateral wall 3.

Besides, when the above-described desk 35 is contemplated, each cut portion 17, 18 comprises a notch 75, 76, respectively, of which the position and configuration permit a proper positioning of said desk 35 by fitting as shown at 36 in FIG. 6.

Of course, other forms of embodiment of the present invention may be conceived by those conversant with the art without departing from the basic principles of the invention. Thus, for instance, according to the particular application contemplated, the post configuration, the fold lines, the apertures and the relative dimensions of the component elements of the isolation hut may be adapted to the specific application contemplated for the isolation hut. Finally, a folding door or the like may be substituted for said curtain for closing the access aperture.

What is claimed as new is:

1. An isolation hut, to be used as a polling-booth during elections or other events, which is made from a sheet of basic folding material such as cardboard, pasteboard or light-weight multilayer material, said isolation hut comprising a plurality of lateral walls and a front access aperture, said lateral walls and said access aperture being adjacent to one another and forming between them a plurality of vertical corner edges, the isolation hut further comprising:

a self-supporting frame structure obtained by folding said basic folding sheet material constituting said lateral walls and said front access aperture, and a plurality of frame posts for stiffening said self-supporting structure, said frame posts being disposed at the vertical edges formed by folding precut areas in said basic folding sheet material, wherein said self-supporting frame structure is reinforced by a desk-forming member extending between said lateral walls and comprising a bracing member between the adjacent and opposite lateral walls, said bracing member being supported in its horizontal position by the corner frame posts disposed between said first lateral wall and said other lateral wall.

2. The isolation hut of claim 1, wherein said frame posts include front posts located at the vertical edges defined by said access aperture and intermediate posts located at the vertical edges defined by the adjacent lateral walls, said front frame posts are obtained by folding lateral precut portions of said basic folding sheet material constituting said self-supporting frame structure.

3. The isolation hut of claim 1, wherein said frame posts comprise front posts formed at the vertical edges defined by said access aperture and intermediate posts formed at the vertical edges defined by the adjacent lateral walls, said intermediate frame posts are obtained by folding precut portions of said lateral walls.

4. The isolation hut of claim 2, wherein the basic folding sheet material comprises a plurality of tongues formed therein adjacent said vertical front edges and a plurality of precut slots corresponding to said tongues which are formed in said lateral areas of each lateral walls adjacent said front access aperture, said tongues being adapted to engage said slots and contributing after the folding step in consolidating said front posts.

5. The isolation hut of claim 3, wherein the basic folding sheet of material comprises portions cuts therein in the lower portion of the lateral walls for constituting, after the folding step, the intermediate posts by coupling with the adjacent lateral walls provided for this purpose with corresponding precut slots.

6. The isolation hut of claim 1, wherein the framework posts have a tubular configuration and a substantially triangular cross section.

7. The isolation hut of claim 1, wherein said self-supporting frame structure is reinforced by a cross bar disposed at the top of the front access aperture, said cross bar acting as a bracing member between the two lateral walls adjacent said front aperture.

8. The isolation hut of claim 7, wherein said front aperture is partically closed by a curtain, and said cross bar is obtained by folding a second sheet of same material as said first sheet material, this folding step providing a gap in which said curtain is adapted to be pinched, said cross bar vfurther comprising end portions adapted to engage openings provided for this purpose in said frame structure posts.

9. The isolation hut of claim 1, wherein said desk is obtained by folding a third sheet of same material as said first sheet, so as to form a triangular-sectioned member, said desk being locked in position by inserting a tongue thereof through a pair of corresponding slots formed in said first lateral wall supporting said desk.

10. An isolation hut made from a single sheet of a light-weight and foldable material, comprising:

(a) a self-supporting frame obtained by folding a sheet material along a plurality of folding lines disposed on said sheet material, said self-supporting frame comprising a plurality of lateral walls and a front access opening, said lateral walls and said front opening being adjacent to one another and forming therebetween a plurality of vertical corner edges, each of said lateral walls comprising a lateral portion along its edge adjacent to said front opening, each said lateral portion comprising a plurality of tongues disposed at spaced intervals at the outer boundary of each said lateral portion and a plurality of slots disposed at spaced intervals at the inner boundary of each said lateral portion to receive said tongues wherein one of said lateral walls comprises a rear wall, said rear wall being disposed opposite to said front opening;

(b) a plurality of reinforcing posts integral with said self-supporting frame for imparting rigidity to said selfsupporting frame and disposed along said vertical corner edges, said vertical corner edges being formed by folding said sheet material along said folding lines, said reinforcing posts comprising a plurality of front posts located along a plurality of said vertical corner edges defined by said front opening and said lateral walls, and a plurality of intermediate posts located adjacent a plurality of said vertical corner edges defined by said lateral walls and said rear wall; and (c) a desk mounted at a portion of said self-supporting frame adapted to be used as a support for various articles of a user.

11. The isolation hut of claim 10, wherein said lateral portion further comprises a plurality of folding-lines, whereby when said lateral portion is folded along said folding lines, each of said tongues engages into a corresponding slot thereby forming one of said front posts.

12. An isolation hut made from a single sheet of a light-weight and foldable material, comprising:

(a) a self-supporting frame obtained by folding a sheet material along a plurality of folding lines disposed on said sheet material, said self-supporting frame comprising a plurality of lateral walls and a front access opening, said lateral walls and said front opening being adjacent to one another and forming therebetween a plurality of vertical corner edges, each of said lateral walls comprising a substantially C-shaped pre-cut portion at its lower portion, wherein one of said lateral walls comprises a rear wall, said rear wall being disposed opposite to said front access opening;

(b) a plurality of reinforcing posts integral with said self-supporting frame for imparting rigidity to said self-supporting frame and disposed along said plurality of vertical corner edges, said vertical corner edges being formed by folding said sheet material along said folding lines, said reinforcing posts comprising a plurality of front posts located along a plurality of said vertical corner edges defined by said front opening and said lateral walls, and a plurality of intermediate posts located adjacent a plurality of said vertical corner edges defined by said lateral walls and said rear wall; and (c) a desk mounted at a portion of said self-supporting frame adapted to be used as a support for various articles of a user;

wherein said rear wall comprises a plurality of longitudinally extending slots at its lower portion such that when said C-shaped portion is folded rearwardly an end portion of said C-shaped portion is received in a plurality of said longitudinally extending slots thereby forming one of said intermediate posts.

13. The isolation hut of claim 12, wherein each of said reinforcing posts is substantially tubular in configuration.

14. The isolation hut of claim 12, wherein each of said reinforcing posts has a substantially triangular cross-section.

15. The isolation hut of claim 12, wherein each of said C-shaped portions comprises a notch at its upper section to receive said desk.

16. The isolation hut of claim 15, wherein said desk comprises a desk anchored on said rear wall and extending between said lateral walls, said desk being formed of a single sheet of foldable material.

17. The isolation hut of claim 16, wherein said desk forming sheet is substantially rectangular in configuration and comprises a plurality of folding-lines along the length thereof and a tab portion for anchoring said desk on said rear wall.

18. The isolation hut of claim 17, wherein said desk is substantially triangular in cross-section when it is folded along said plurality of folding-lines.

19. The isolation hut of claim 12, further comprising a cross-bar positioned at the top of said front opening for connecting said lateral walls adjacent said front opening.

20. The isolation hut of claim 12, wherein a corrugated curtain is hung from said cross-bar for closing and opening said front opening.

* * * * *